United States Patent [19]

Bull et al.

[11] Patent Number: 4,529,147

[45] Date of Patent: Jul. 16, 1985

[54] CARRIER FOR A STRAND SUPPLY BOBBIN

[75] Inventors: Jeffrey F. Bull, Akron; Michael E. Winiasz, Lorain, both of Ohio

[73] Assignee: James F. Karg, Akron, Ohio

[21] Appl. No.: 648,064

[22] Filed: Sep. 7, 1984

[51] Int. Cl.[3] ..... B65H 59/02

[52] U.S. Cl. ..... 242/156.2; 87/57; 242/128; 242/129.8

[58] Field of Search ..... 242/156, 156.2, 128, 242/129.8, 75.4, 75.43; 87/55, 56, 57

[56] References Cited

U.S. PATENT DOCUMENTS

| | | | |
|---|---|---|---|
| 2,459,617 | 1/1949 | Carter | 242/156 X |
| 2,988,300 | 6/1961 | Woods et al. | 242/156.2 |
| 3,004,463 | 10/1961 | Griesemer | 87/56 |
| 3,425,315 | 2/1969 | Kaufman | 87/57 X |
| 3,756,533 | 9/1973 | De Young | 242/156.2 |
| 3,757,904 | 9/1973 | De Young | 242/156.2 X |
| 3,802,643 | 4/1974 | De Young | 242/156 |
| 3,817,147 | 6/1974 | Richardson | 87/57 X |
| 3,839,939 | 10/1974 | Wiley | 87/57 |
| 4,375,279 | 3/1983 | Koch | 242/156 |

*Primary Examiner*—Stanley N. Gilreath

*Attorney, Agent, or Firm*—Mack D. Cook, II

[57] ABSTRACT

A carrier for a strand supply bobbin used on strand fabricating machines. The carrier has a raisable and generally circular cap (32) housing a sleeve (37), a disc (38), a ring (39), a compression spring (40), a leaf spring (41), an actuator rod (42), a collar nut (43), a retainer cup (44), a planar reaction surface (45), an actuator plug (46) and freely movable force transmitting elements (47), as operative elements for bobbin control during letoff of strand material. Radial movement of the force transmitting elements (47), to brake or clutch the supply bobbin is determined by (i) the position of the bobbin control actuator rod (42), (ii) the position of the bobbin control actuator rod (46), and (iii) the position of the bobbin control disc (38) within the raisable cap (32) on the carrier.

4 Claims, 6 Drawing Figures

CARRIER FOR A STRAND SUPPLY BOBBIN

BACKGROUND OF THE INVENTION

The invention relates to a carrier for a strand supply bobbin used on strand fabricating machines.

Strand fabricating machines may be provided with sets of carriers according to the invention. The carrier sets are moved by components of the fabricating machines along circular paths in opposite directions relative to the "work center" of the machine. Tensioned strands from the supply bobbins are incrementally released toward the machine work center. The tensioned strands may be interlaced, woven, braided or spiraled as to each other or around a core member.

Commercial products now being made on state of the art strand fabricating machines are many and varied; ranging from common garden hose to sophisticated multiple ply, wirewound high pressure hydraulic hose. Whatever the design and construction of the fabricating machine, the operating characteristerics of the carriers for strand supply bobbins are critical to the manufacture of quality products.

It is deemed essential that strand fabricating machines use strand carriers that provide instantaneous braking action as well as accurate tension settings and minimum variations in tension during strand release and letoff.

Relevant prior art known to applicants is: U.S. Pat. No. 2,459,617, 1/1949, Carter, Class 242/156; U.S. Pat. No. 3,757,904, 9/1973, DeYoung, Class 188/82.3; U.S. Pat. No. 3,817,147, 6/1974, Richardson, Class 87/57; U.S. Pat. No. 3,839,939, 10/1974, Wiley, Class 87/57; and U.S. Pat. No. 4,375,279, 3/1983, Koch, Class 242/156.

SUMMARY OF THE INVENTION

It is an object of the invention to provide an improved carrier for a strand supply bobbin used on strand fabricating machines.

It is a further object of the invention to provide a strand carrier with instantaneous braking action as well as accurate tension settings and minimum variations in tension during strand release and letoff.

These and other objects of the invention, as well as the advantages thereof, will become apparent in view of the drawings and the detailed description.

A strand carrier according to the invention combines a disc brake with a high ratio release mechanism. The braking action is clutched with minimal actuating force providing a predetermined or setpoint release which is not affected by varying torque on the letoff length of strand material moving toward the work center or braiding point of a strand fabricating machine.

A strand supply bobbin replaceably carried by an apparatus according to the invention is known in the art. The supply bobbin is a spool having opposed base and control side flanges carried by an elongate hub. A strand package is wound around the hub between the side flanges prior to installation of the spool on the carrier.

The carrier has a base member adapted for rotatable mounting of the spool hub. The base member has a stanchion extending from and adjacent to a spool base side flange and terminating adjacent to a spool control side flange. The base member also has an extending post generally opposed to the stanchion.

The carrier further has a raisable and generally circular cap connected to the base member stanchion and to the base member extending post, over a supply bobbin. The raisable cap has a series of stepped axial bores including a smaller diameter first bore for fixed mounting of the medial portion of a bobbin control sleeve, a larger diameter second bore for rotatable and slidable mounting of a hub portion of a bobbin control disc, and a still larger diameter third bore for fixed mounting of a bobbin control ring.

The bobbin control sleeve has a medial portion fixedly mounted in the raisable cap first bore, an outer portion projecting from the medial portion and beyond the raisable cap, and a base portion projecting from the medial portion and toward the spool control side flange. The control sleeve also has an annular external flange between the medial portion and the base portion and an internal flange with an axial bore between the medial portion and the base portion. The outer portion has a fixed cap with an axial bore. The base portion has a projecting collar enclosing a conical reaction surface extending radially of the internal flange axial bore.

The bobbin control disc has a hub portion rotatably and slidably mounted in the raisable cap second bore, a medial portion extending from the hub portion and around the bobbin control sleeve external flange and radially outwardly within the raisable cap third bore and terminating in a peripheral reaction surface for selective engagement with the fixedly mounted bobbin control ring, and a base face having a series of projecting elements for mating engagement with the spool control side flange.

A bobbin control compression spring is coiled within the bobbin control sleeve medial and outer portions. The compression spring has a base end seated on the sleeve internal flange and a reactive free end projecting toward the sleeve outer portion fixed cap.

A bobbin control leaf spring is mounted around the bobbin control sleeve medial portion and has a base side supported by the sleeve external flange. The leaf spring has a reactive free end in contact with the bobbin control disc hub portion.

A bobbin control actuator rod is slidably mounted in the bobbin control sleeve outer portion fixed cap and positioned coaxially within the bobbin control compression spring. The actuator rod has a base end directed toward the sleeve internal flange axial bore and a free end projecting beyond the sleeve outer portion fixed cap for the mounting of a rotatable means responsive to the tension of letoff and moving strand material from a supply bobbin.

A bobbin control collar nut is positioned within the bobbin control sleeve outer portion and in adjustable contact with the bobbin control compression spring free end. The collar nut is responsive to manual rotation of the bobbin control actuator rod to incrementally compress the compression spring.

A bobbin control retainer cup is carried on the bobbin control disc base face coaxially within the projecting elements thereon. The retainer cup has an axial portion enclosing the bobbin control sleeve base portion.

A bobbin control planar reaction surface is supported by the bobbin control retainer cup axial portion perpendicular to the axis of the bobbin control sleeve internal flange axial bore.

A bobbin control actuator plug has a stem portion slidably mounted in the bobbin control sleeve internal flange axial bore and projecting into the sleeve medial portion and a tapered medial portion directed toward the bobbin control planar reaction surface.

A series of freely movable force transmitting elements are within the control sleeve base portion in a space between the sleeve conical reaction surface and the bobbin control planar reaction surface and around the bobbin control actuator plug tapered medial portion. Radial movement of the force transmitting elements for bobbin control, to fully brake the bobbin (as in FIG. 3) or to fully clutch the bobbin (as in FIG. 4) or to establish intermediate conditions, is determined by (i) the position of the bobbin control actuator rod, (ii) the position of the bobbin control actuator plug, and (iii) the position of the bobbin control disc within the raisable cap, when the control disc base face projecting elements are in mating engagement with the spool control side flange.

IN THE DRAWINGS

Figure 1:
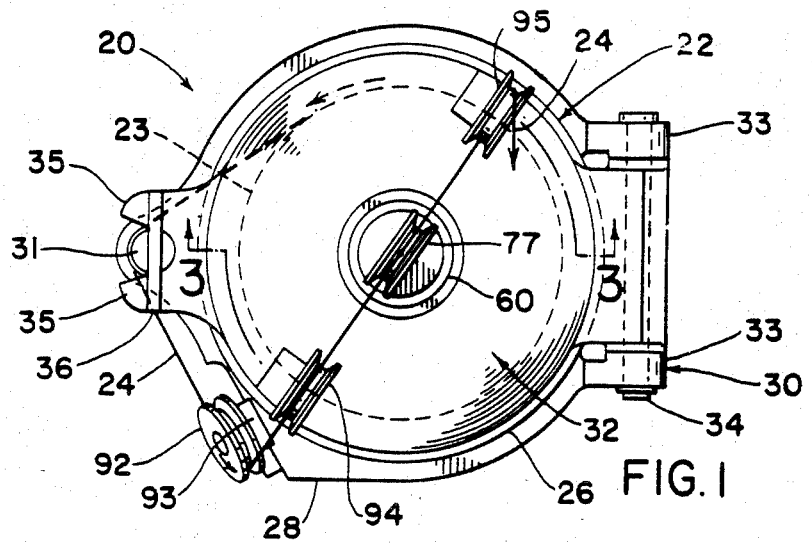
FIG. 1 is a top view of a carrier for a strand supply bobbin, according to the invention.
Figure 2:
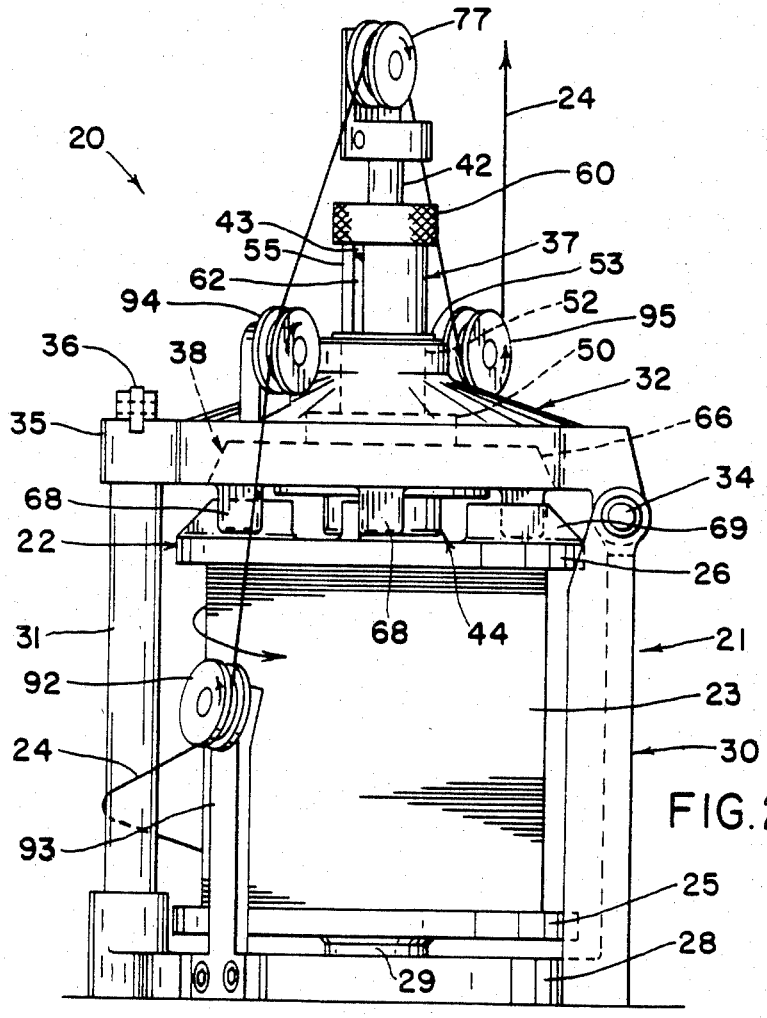
FIG. 2 is a side view of the carrier.
Figure 3:
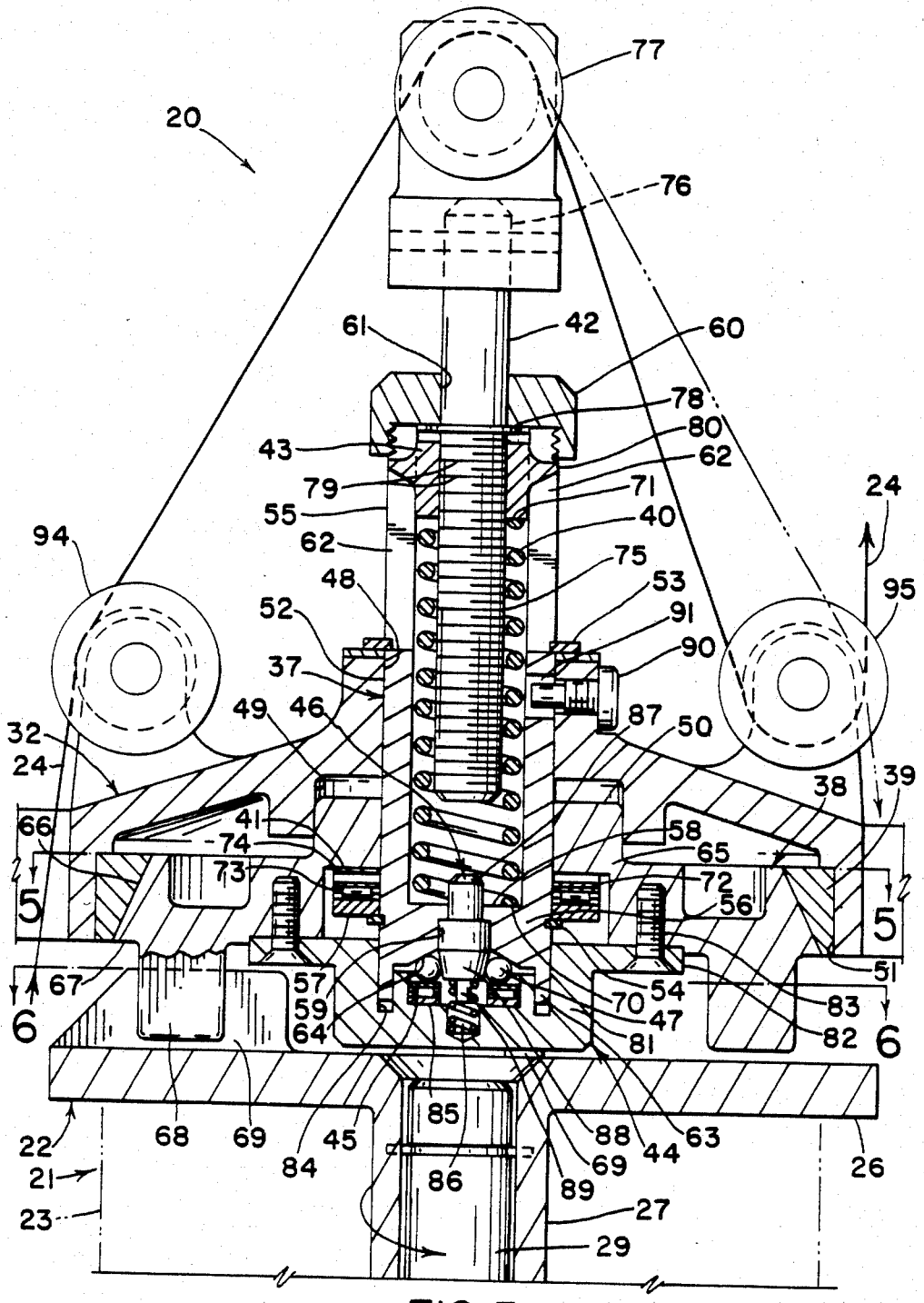
FIG. 3 is an enlarged sectional view in elevation of the upper portion of the carrier, taken substantially as indicated on line 3—3 of FIG. 1.
Figure 4:
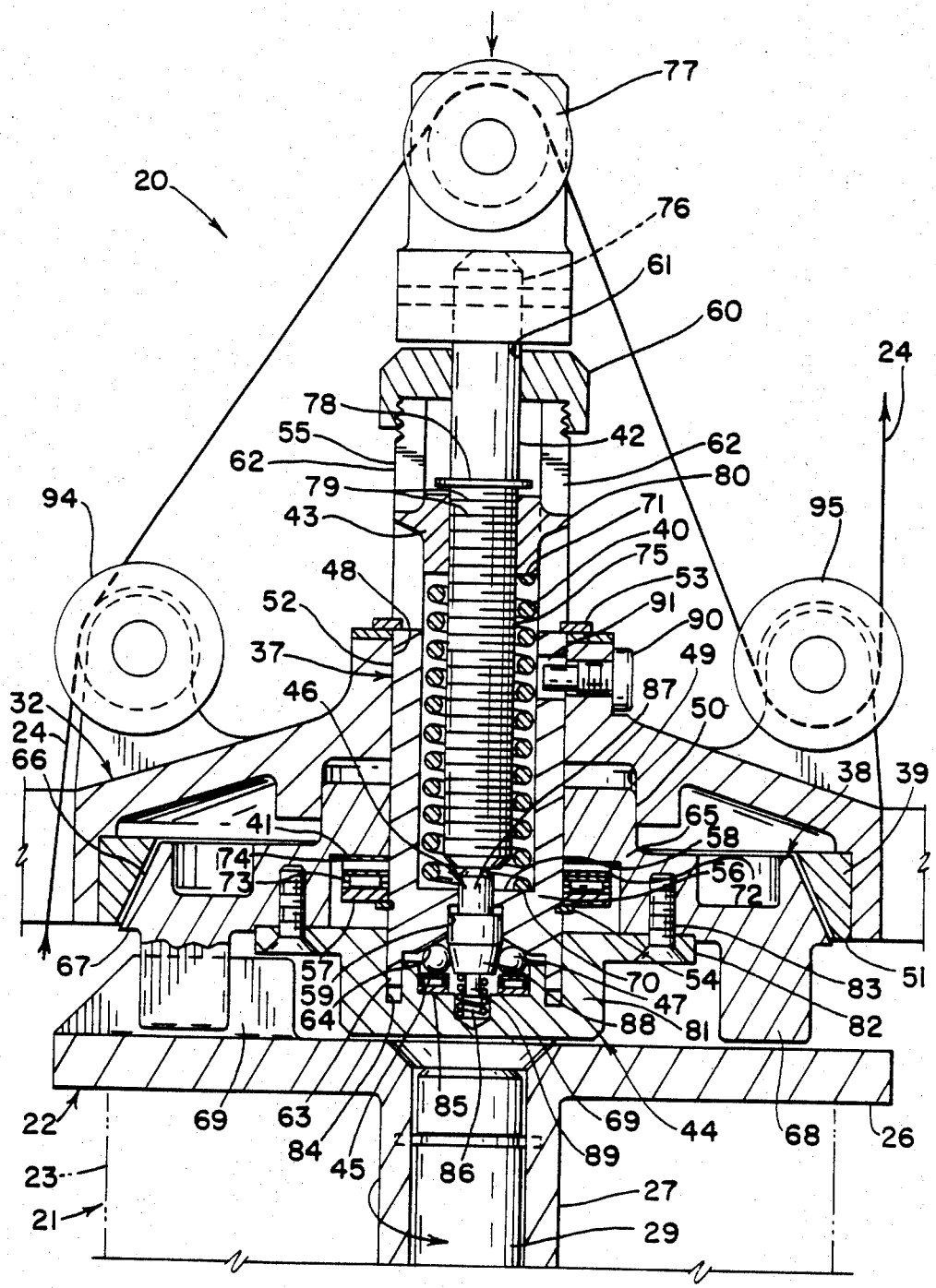
FIG. 4 is another sectional view in elevation, similar to FIG. 3.

FIGS. 3 and 4 show the two extreme conditions of strand letoff control. In FIG. 3, the supply bobbin is braked and does not rotate. In FIG. 4, the supply bobbin is clutched and free to rotate.

Figure 5:
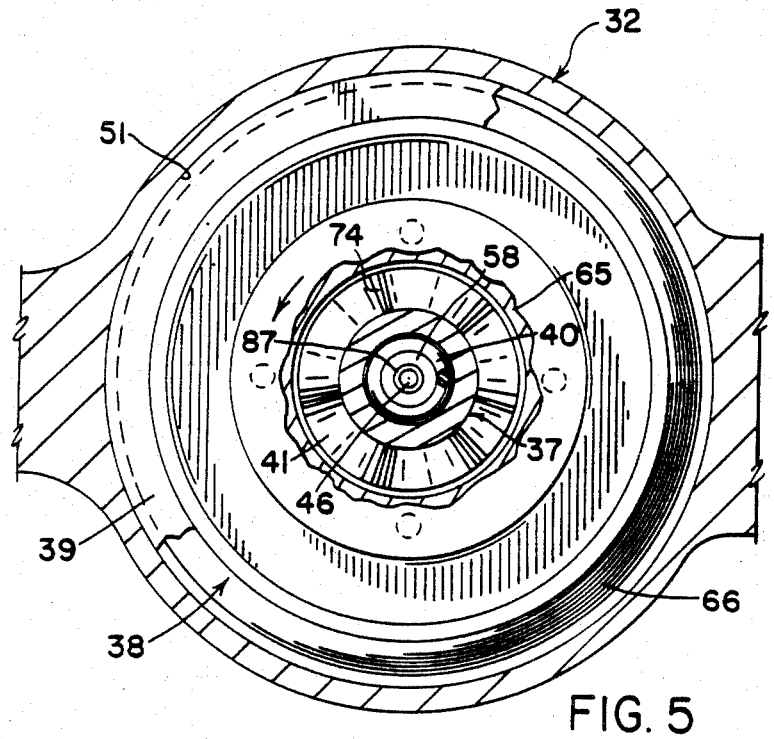
Figure 6:
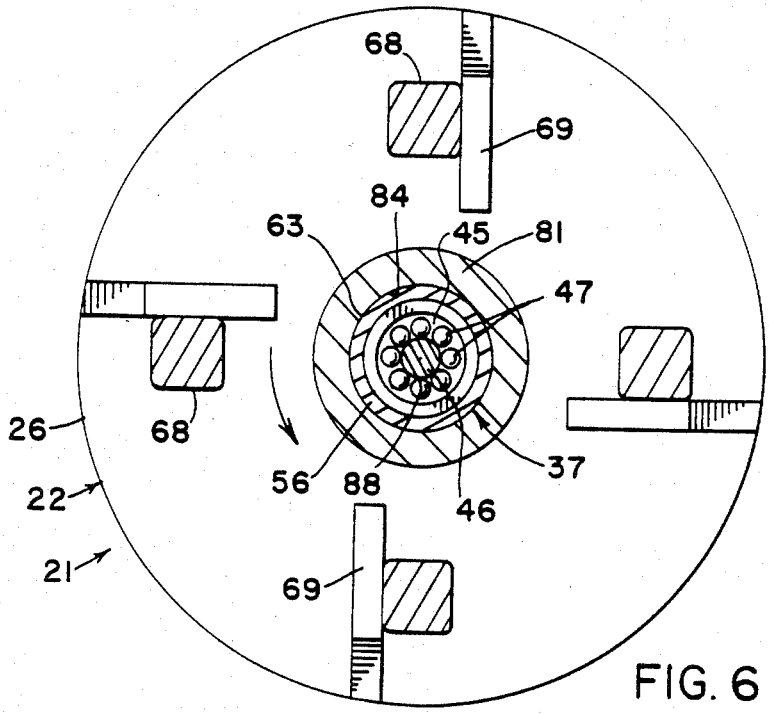

FIG. 5 is a sectional view in plan, taken substantially as indicated on line 5—5 of FIG. 3; and FIG. 6 is another sectional view in plan, below FIG. 5, taken substantially as indicated on line 6—6 of FIG. 3;

DETAILED DESCRIPTION OF THE INVENTION

A carrier for a strand supply bobbin, according to the invention, is referred to generally by the numeral 20. A strand supply bobbin, referred to generally by the numeral 21, comprises spool 22, a package of wound strand material 23, and a letoff length or free end of strand material 24.

A bobbin spool 22 has opposed base and control side flanges, 25 and 26 respectively, carried by an elongate hub 27. A strand package 23 is tightly wound around the hub 27, between the side flanges 25 and 26, prior to installation of the spool 22 on the carrier 20.

A carrier 20 has a base member 28, adapted for rotatable mounting of a strand supply bobbin 21 and for rotational movement on a component of a strand fabricating machine (not shown). As shown, the base member 28 carries an axial post 29 for insertion and selective retention within the spool hub 27. The base member 28 has a stanchion 30 extending from and adjacent to a spool base side flange 25 and terminating adjacent to a spool control side flange 26. The base member 28 also has an extending post 31 opposed to the stanchion 30.

A carrier 20 has a raisable and generally circular cap 32 hingedly connected to the base member stanchion 30. As shown, the stanchion 30 has dual side yokes 33 engaging a fixed cross pin 34 carried by the cap 32. The cap 32 is selectively latched to the base member extending post 31. As shown, the cap 32 has a forked side plate 35 for positioning around the post 31 and locking engagement by a latch bar 36.

The primary elements of a carrier 20 intended for precise and efficient control of a supply bobbin 21 and letoff of strand material 24 from the spool package 23 are housed by the raisable cap 32 and comprise or include: a sleeve 37; a disc 38; a ring 39; a compression spring 40; a leaf spring 41; an actuator rod 42; a collar nut 43; a retainer cup 44; a planar reaction surface 45; an actuator plug 46; and, freely movable force transmitting elements 47.

The raisable cap 32 has an underside formed with a series of stepped axial bores. A smaller diameter first or upper bore 48 is for fixed mounting of the medial portion of the bobbin control sleeve 37. A larger diameter second or middle bore 49 is for rotatable and slidable mounting of the axial hub 50 of the bobbin control disc 38. A still larger diameter third or lower bore 51 is for fixed mounting of the bobbin control ring 39.

The bobbin control sleeve 37 has a medial portion 52 which is fixedly mounted in the raisable cap first bore 48 as by upper and lower retainer rings, 53 and 54 respectively. A sleeve outer portion 55 projects from the medial portion 52 and beyond the raisable cap 32. A sleeve base portion 56 projects from the medial portion 52 and toward the spool side flange 26.

The bobbin control sleeve 37 also has an annular external flange 57 between the sleeve portions 52 and 56. As shown, the external flange 57 is formed by a ring collar seated on the lower retainer ring 54. The sleeve 37 also has an internal flange 58 between the sleeve portions 52 and 56. The flange 58 is formed with a stepped axial bore 59 for positioning and slidable mounting of a bobbin control acuator plug 46.

The sleeve outer portion 55 carries a fixed cap 60. The sleeve cap 60 has an axial bore 61, aligned with the sleeve internal flange axial bore 59. Between the sleeve cap 60 and the raisable cap 32, the sleeve outer portion 55 has opposed guide or tension indicator slots 62.

The sleeve base portion 56 has a projecting collar 63. The collar 63 encloses a conical reaction surface 64 extended radially of the internal flange axial bore 59. The reaction surface 64 engages the freely movable force transmitting elements 47.

The bobbin control disc 38 has a hub portion 50 which is rotatably and slidably mounted in the raisable cap second bore 49. A disc medial portion 65 extends from the hub 50 and around the control sleeve external flange 57 and radially outwardly within the raisable cap third bore 51. The disc medial portion 65 terminates in a peripheral reaction surface 66 for selective engagement with the fixedly mounted control ring 39. The lower side or base face 67 of the disc 38 has a series of projecting dog elements 68 providing means for mating engagement with a series of projecting ribs 69 carried on the spool side flange 26.

The bobbin control compression spring 40 is coiled within the control sleeve medial and outer portions 52 and 55. The compression spring 40 has a base end 70 seated on the sleeve internal flange 58 and a reactive free end 71 projecting toward the sleeve fixed cap 60.

The bobbin control leaf spring 41 is mounted around the control sleeve medial portion 52. As shown, the leaf spring 41 has a base side 72 engaging a roller bearing assembly 73 supported by the sleeve external flange 57. The leaf spring 41 has a reactive free end 74 in contact with the underface of the control disc hub 50.

The bobbin control actuator rod 42 is slidably mounted in the control sleeve fixed cap axial bore 61 and positioned coaxially within the control compression spring 40. The actuator rod 42 has a base end 75 directed toward the sleeve internal flange axial bore 59 and a free end 76 projecting beyond the control sleeve fixed cap 60. The actuator rod free end 76 is adapted for the fixed mounting of a pulley assembly 77 providing a rotatable means which is immediately, directly or positively responsive to the tension of letoff and moving strand material 24 from the supply bobbin 21. The maximum distance betweeen the pulley assembly 77 and the control sleeve fixed cap 60 is determined by the placement of a snap ring collar 78 on the actuator rod 42.

The bobbin control collar nut 43 is positioned within the control sleeve outer portion 55 and in adjustable contact with the compression spring free end 71. The collar nut 43 is responsive to manual rotation of the control actuator rod 42 to incrementally compress the control spring 40. As shown, the collar nut 43 has internal threads for mating engagement with external threads 79 on the actuator rod base end 75. A precompression of the control spring 40 will determine the force being exerted by the spring 40, through the collar nut 43, the actuator rod 42 and the pulley assembly 77, against the tension of the moving strand material 24. Stated another way, a precompression of the control spring 40 will determine the quantum increase of tension on strand 24 to reach the fully clutched condition, as shown in FIG. 4.

The control nut 43 is restrained from rotation during manual rotation of the control actuator rod 42 by opposed ears 80 projecting into the control sleeve guide slots 62. The guide slots 62 may be marked and calibrated (not shown) so that the relative position of the collar nut ears 80 therein will indicate an analog of the compression of the control spring 40.

The bobbin control retainer cup 44 is carried on the control disc base face 67 coaxially within the projecting elements 68 thereon and has an axial portion 81 enclosing the control sleeve base portion 56. The retainer cup 44 may be attached to the control disc 38 as by a radial flange 82 and machine screws 83. As shown, the control sleeve base portion projecting collar 63 is received in an annular groove 84. Radially inwardly of the groove 84 is a stepped axial bore 85 for positioning of the bobbin control planar reaction surface 45 and a small diameter compression spring 86 engaging the bobbin control actuator plug 46.

The bobbin control planar reaction surface 45 is supported by the retainer cup axial portion 81 perpendicular to the axis of the sleeve internal flange axial bore 59. As shown, the planar reaction surface 45 is the upper race of a roller bearing seated in the retainer cup axial bore 85 and supporting the freely movable force transmitting elements 47.

A bobbin control actuator plug 46 has an upper stem portion 87 slidably mounted in the control sleeve internal flange axial bore 59 and projecting into the sleeve medial portion 52. The actuator plug 46 also has a tapered medial portion 88 directed toward the control planar reaction surface 45 for actuating radial movement of the force transmitting elements 47. As shown, the actuator plug 46 also has a lower stem 89 for piloting the free end of the small compression spring 86.

As shown, the series of freely movable force transmitting elements 47 are spherical balls of uniform diameter within the control sleeve base portion 56. The balls 47 are housed within a space or area between the sleeve conical reaction surface 64 and the control planar reaction surface 45 and around the bobbin control actuator plug tapered medial portion 88. Radial movement of the balls 47, to brake the supply bobbin 21 (FIG. 3) or to clutch the supply bobbin 21 (FIG. 4), is determined by (i) the position of the bobbin control actuator rod 42, (ii) the position of the bobbin control actuator plug 46, and (iii) the position of the bobbin control disc 38 within the raisable cap 32, when the control disc base face projecting dog elements 68 are in mating engagement with the spool control side flange ribs 69.

A strand carrier 20 may have additional elements not described above.

The bobbin control sleeve 37 is fixedly mounted in the raisable cap first bore 48 as by upper and lower retainer rings, 53 and 54 respectively. Rotation of the control sleeve 37 within the cap bore 48 may be restrained as by a threaded plug 90 extending laterally into a bore 91 in the control sleeve 37.

The bobbins control actuator rod 42 carries a pulley assembly 77 providing a rotatable means which is immediately, directly or positively responsive to the tension of letoff and moving strand material 24 from the supply bobbin 21. As shown, idler or passive rotatable strand material guide means are provided by: A pulley assembly 92 carried by a bracket 93 affixed to the carrier base member 28 and positioned medially of a strand package 23; a pulley assembly 94 carried on the raisable cap 32 between the pulley assembly 92 and the pulley assembly 77; and a pulley assembly 95 carried on the raisable cap 32, opposed to the pulley assembly 94, for selectively directing moving strand material 24 away from the carrier 20 toward the work center or braiding point of a strand fabricating machine (not shown).

What is claimed is:

1. A carrier for a strand supply bobbin, said supply bobbin being a spool having opposed base and control side flanges carried by an elongate hub and a strand package wound around said hub between said side flanges, said carrier having a base member adapted for rotatable mounting of said spool hub, a stanchion extending from and adjacent to said spool base side flange and terminating adjacent to a spool control side flange, and an extending post generally opposed to said stanchion, said carrier further comprising:

a raisable and generally circular cap connected to said base member stanchion and to said base member extending post, over said supply bobbin, said raisable cap having a series of stepped axial bores therein including a smaller diameter first bore, a larger diameter second bore, and a still larger diameter third bore;

a bobbin control sleeve having a medial portion fixedly mounted in said raisable cap first bore, an outer portion projecting from said medial portion and beyond said raisable cap, and a base portion projecting from said medial portion and toward said spool control side flange, said control sleeve also having an annular external flange between said medial portion and said base portion and an internal flange with an axial bore between said medial portion and said base portion, said outer portion having a fixed cap with an axial bore, said base portion having a projecting collar enclosing a conical reaction surface extending radially from said internal flange axial bore;

a bobbin control ring fixedly mounted in said raisable cap third bore a bobbin control disc having a hub portion rotatably and slidably mounted in said raisable cap second bore, a medial portion extending from said hub portion and around said bobbin control sleeve external flange and radially outwardly within said raisable cap third bore and terminating in a peripheral reaction surface for selective engagement with said fixedly mounted bobbin control ring, and a base face having a series of projecting elements for mating engagement with said spool control side flange;

a bobbin control compression spring coiled within said bobbin control sleeve medial and outer portions and having a base end seated on said sleeve internal flange and a reactive free end projecting toward said sleeve outer portion fixed cap;

a bobbin control leaf spring mounted around said bobbin control sleeve medial portion and having a base side supported by said sleeve external flange and a reactive free end in contact with said bobbin control disc hub portion;

a bobbin control actuator rod slidably mounted in said bobbin control sleeve outer portion fixed cap and positioned coaxially within said bobbin control compression spring, and having a base end directed toward said sleeve internal flange axial bore and a free end projecting beyond said sleeve outer portion fixed cap for the mounting of a rotatable means responsive to the tension of letoff and moving strand material from said supply bobbin;

a bobbin control collar nut positioned within said bobbin control sleeve outer portion and in adjustable contact with said bobbin control compression spring free end and responsive to manual rotation of said bobbin control actuator rod to incrementally compress said compression spring;

a bobbin control retainer cup carried on the bobbin control disc base face coaxially within said projecting elements thereon and having an axial portion enclosing said bobbin control sleeve base portion;

a bobbin control planar reation surface supported by said bobbin control retainer cup axial portion perpendicular to said bobbin control sleeve internal flange axial bore;

a bobbin control actuator plug having a stem portion slidably mounted in said bobbin control sleeve internal flange axial bore and projecting into said sleeve medial portion and a tapered medial portion directed toward said bobbin control planar reaction surface; and, a series of freely movable force transmitting elements within said bobbin control sleeve base portion in a space between said sleeve conical reaction surface and said bobbin control planar reaction surface and around said bobbin control actuator plug tapered medial portion, radial movement of said force transmitting elements for control of said supply bobbin being determined by (i) the position of said bobbin control actuator rod, (ii) the position of said bobbin control actuator plug, and (iii) the position of said bobbin control disc within said raisable cap, when said control disc base face projecting elements are in mating engagement with said spool control side flange.

2. A carrier according to claim 1 wherein said freely movable force transmitting elements are spherical balls of uniform diameter.

3. A carrier according to claim 1 wherein said bobbin control sleeve has opposed guide slots, between said sleeve fixed cap and said raisable cap, and said bobbin control nut has opposed ears projecting into said control sleeve guide slots, so that the relative position of said control nut opposed ears in said control sleeve guide slots may indicate an analog of the compression of said bobbin control compression spring.

4. A carrier according to claim 1 wherein said bobbin control retainer cup axial portion has a stepped axial bore for positioning said bobbin control planar reaction surface and for seating a small diameter compression spring, and said bobbin control actuator plug has a lower stem for piloting the free end of said small compression spring.

* * * * *